United States Patent [19]

Riemens et al.

[11] 4,355,204

[45] Oct. 19, 1982

[54] SPEECH SYNTHESIZING ARRANGEMENT HAVING AT LEAST TWO DISTORTION CIRCUITS

[75] Inventors: Karel Riemens; Joannes G. M. Van Thuijl, both of Eindhoven, Netherlands

[73] Assignee: U.S. Philips Corporation, New York, N.Y.

[21] Appl. No.: 197,450

[22] Filed: Oct. 16, 1980

[30] Foreign Application Priority Data

Nov. 9, 1979 [NL] Netherlands ..... 7908213

[51] Int. Cl.[3] ..... G10L 1/00

[52] U.S. Cl. ..... 179/1 SA; 179/1 SM

[58] Field of Search ..... 179/1 SM, 1 SA, 1 SG; 364/513, 514; 84/1.01

[56] References Cited

U.S. PATENT DOCUMENTS

| | | | |
|---|---|---|---|
| 2,908,761 | 10/1959 | Raisbeck | 179/1 SA |
| 3,431,362 | 3/1969 | Miller | 179/1 SA |
| 3,499,991 | 3/1970 | Cassel et al. | 179/1 SA |
| 3,872,250 | 3/1975 | Coulter | 179/1 SA |
| 4,034,160 | 7/1977 | Van Gerwin | 179/1 SA |

*Primary Examiner*—Errol A. Krass
*Assistant Examiner*—E. S. Kemeny
*Attorney, Agent, or Firm*—Thomas A. Briody; William J. Streeter; Edward W. Goodman

[57] ABSTRACT

This improved voice-excited speed synthesizer expands the voice-band spectrum to generate high-frequency band excitation signal by using two separate distortion networks: a full-wave rectifier for lower frequencies, and a limiter for higher frequencies. Channel and formant type voice excited embodiments are shown.

2 Claims, 4 Drawing Figures

SPEECH SYNTHESIZING ARRANGEMENT HAVING AT LEAST TWO DISTORTION CIRCUITS

BACKGROUND OF THE INVENTION

The invention relates to an arrangement for synthesizing speech from a band of low-frequency components of a speech signal and a plurality of narrowband control signals which are characteristic of a plurality of sub-bands of high-frequency components of the speech signal, comprising means for generating a band of high-frequency components from the band of low-frequency components, means for dividing the band of high-frequency components into a number of sub-bands corresponding to the sub-bands of high-frequency components of the speech signal, means for correcting, by means of the control signals, the sub-bands derived from the generated band and means for combining the band of low-frequency components with the corrected sub-bands of the generated high-frequency components to a speech output signal.

Arrangements of such a type are used as speech-synthesizing arrangements in voice-excited vocoders. Voice-excited vocoders can be distinguished into channel vocoders and formant vocoders, depending on the manner in which the sub-bands of high-frequency components are chosen and on the character of the control sgnals derived therefrom. For channel vocoders the starting point is a, usually rather large, number of contiguous sub-bands from which control signals are derived which are a measure of the average signal amplitude in each sub-band. The arrangement described in U.S. Pat. No. 3,139,487 may be considered an example of such a channel vocoder. For formant vocoders the sub-bands are formed by a small number, usually three or four, formant ranges, the control signals supplying information about the frequency and the amplitude of the spectral peaks occurring in a formant range. An example of such a formant vocoder is described in J. L. Flanagan, "Resonance-vocoder and baseband complement", IRE Transactions on Audio AU-8, 1960, pages 95–102.

Such vocoders utilize a distortion network for the generation of a band of high-frequency components from the band of low-frequency components. Known simple distortion networks such as limiters and rectifier circuits were not very satisfactory since they resulted in speech output signals which sound unnatural or at least less natural. Consequently very complicated distortion networks have been designed. In this connection reference is made to, for example, M. R. Schroeder and E. E. David Jr., "A vocoder for transmitting 10 kc/s speech over a 3.5 kc/s channel", Acustica No. 10, 1960, pages 35–43, FIG. 5 in particular.

SUMMARY OF THE INVENTION

It is an object of the invention to provide an arrangement of the type defined in the opening paragraph with which a speech output signal which sounds as naturally as possible is obtained in spite of the fact that a simple distortion network is used.

According to the invention, the arrangement is therefore characterized in that the means for generating a band of high-frequency components comprises at least two circuits, each generating a band of high-frequency components from the band of low-frequency components of the speech signal, a portion of the number of sub-bands being derived from each of the generated bands.

In an advantageous embodiment of the arrangement according to the invention, a first circuit is formed by a full-wave rectifier circuit for generating a relatively low-frequency band of high-frequency components and a second circuit is formed by a limiting circuit for generating a relatively high-frequency band of high-frequency components.

DESCRIPTION OF THE DRAWINGS

The invention will now be further explained, by way of non-limitative example, with reference to the accompanying drawings. Therein.

Identical components have been given the same reference numerals in the Figures.

DESCRIPTION OF THE PREFERRED EMBODIMENTS

Figure 1:
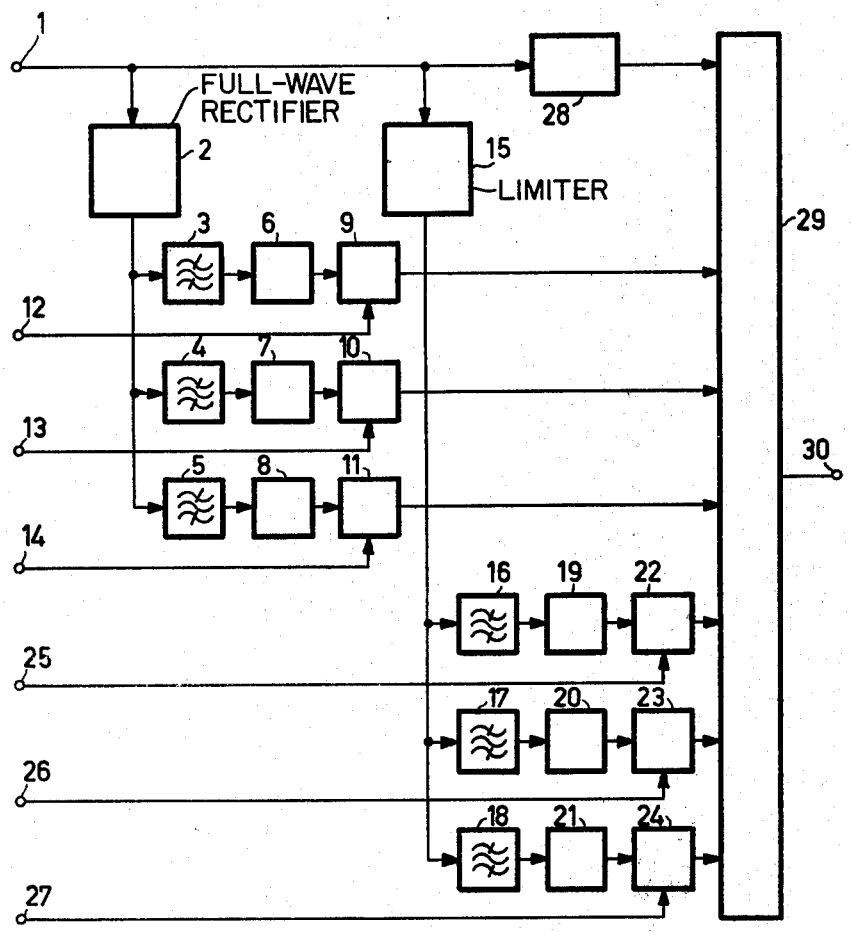
FIG. 1 shows a first embodiment of an arrangement according to the invention for use in a channel vocoder.

In the arrangement shown in FIG. 1, a band of low-frequency components of a speech signal (base-band signal), e.g. derived from a speech analyzer of the type as disclosed in U.S. Pat. No. 3,139,487, is applied to an input terminal 1. From this base-band signal, which has a frequency spectrum extending from, for example, 300 to 1500 Hz, there is generated by means of a first distortion circuit 2 a relatively low-frequency band of high-frequency components, which band is divided into contiguous sub-bands of, for example, 1600–1850 Hz, 1850–2100 Hz and 2100–2350 Hz by means of a number of band-pass filters 3, 4 and 5. By means of a number of control circuits 6, 7 and 8, the amplitudes of the generated sub-bands are standardized. The sub-bands with standardized amplitudes thus obtained are applied to analogue multipliers 9, 10 and 11, the generated sub-bands being corrected thereafter by means of an identical number of control signals, obtained from the input terminals 12, 13 and 14. e.g., derived from a speech analyzer of the type as disclosed in U.S. Pat. No. 3,139,487, which are a measure of the average amplitude in the corresponding sub-bands of the original speech signal.

From the baseband signal applied to the input terminal 1 there is generated by means of a second distortion circuit 15 a relatively high-frequency band of high-frequency components, which band is divided into contiguous sub-bands of, for example, 2350–2850 Hz, 2850–3350 Hz and 3350–3850 Hz by means of band-pass filters 16, 17 and 18. After standardization of the amplitudes in a number of control circuits 19, 20 and 21, the generated sub-bands are applied to analogue multipliers 22, 23 and 24, respectively, to which also a number of control signals originating from the input terminals 25, 26 and 27, respectively, are applied.

This, there are obtained at the outputs of the analogue multipliers 9, 10, 11, 22, 23 and 24 a number of corrected sub-bands of high-frequency components, which sub-bands are a closest possible approximation of the sub-bands which were derived in the analyzing portion, not shown, of a channel vocoder from the original speech signal. The corrected sub-bands are applied, possibly via appropriate simple band-pass filters, together with the base-band signal which was delayed by a delay circuit 28, to an adder device 29, whereafter the synthesized speech output signal appears to an output terminal 30.

Figure 2:
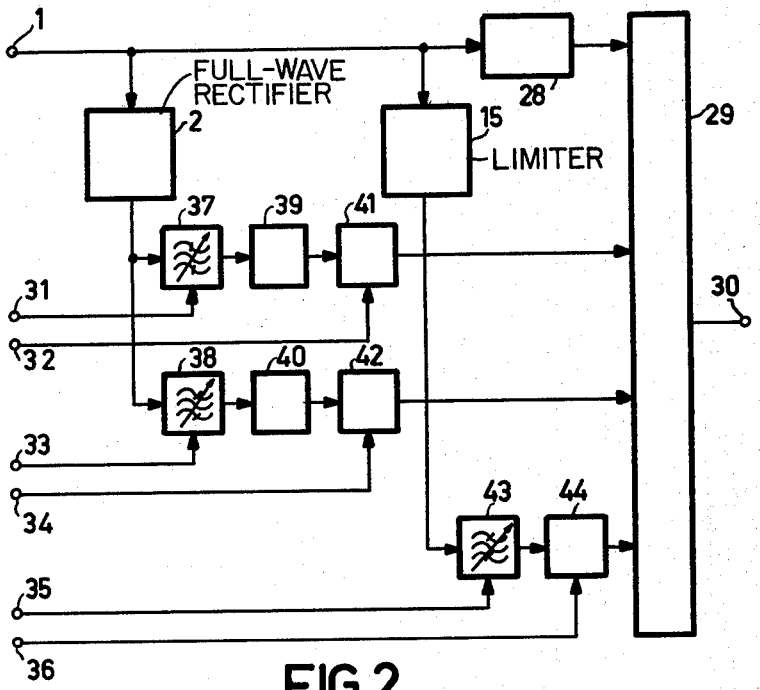
FIG. 2 shows a second embodiment of an arrangement according to the invention for use in a formant vocoder.

The arrangement shown in FIG. 2 comprises an input terminal 1, to which a base-band signal is applied, for example a band of 300–700 Hz. Control signals which furnish information about the amplitude and the frequency, respectively, of a spectral maximum occurring in a first sub-band (for example 800–1500 Hz) are applied to input terminals 31 and 32. In a similar manner, an amplitude and a frequency control signal, which relate to a second sub-band (for example 1500–2200 Hz) are applied to input terminals 33 and 34, and similar control signals relating to a third sub-band (2200–3200 Hz) are applied to input terminals 35 and 36. The said sub-bands are determined by the analyzing portion, not shown, of a formant vocoder. It should be noted that the first and the second sub-bands together cover the second formant range and that the third sub-band covers the third formant range of a speech signal originating from a male voice.

Bands of high-frequency components are formed from the base-band signal by means of the distortion circuits 2 and 15. The band originating from the distortion circuit 2 is divided by means of band-pass filters 37 and 38, which have a variable resonant frequency, into two sub-bands which, by means of the control circuits 39 and 40 and the analogue multipliers 41 and 42, are made equal as closely as possible, under the control of the control signals at the input terminals 31 and 32 and the control signals at the input terminals 33 and 34, respectively, to said first and second sub-bands, respectively, which together cover the second formant range. The band of high-frequency components produced by the distortion circuit 15, is made equal, as closely as possible by means of a band-pass filter 43, which has a variable resonant frequency, and by an analogue multiplier 44 under the control of the control signals at the input terminals 35 and 36, to the third sub-band covering the third formant.

The corrected sub-bands occurring at the outputs of the analogue multipliers 41, 42 and 44 are applied to the adder device 29 together with the base-band signal after having been delayed in the delay circuit 28 to compensate for the delay time occurring in the filters, whereafter the synthesized speech output signal is found at the output terminal 30.

Figure 3:
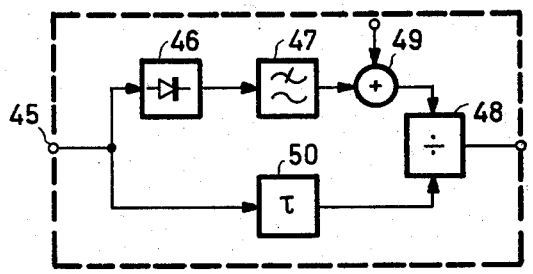
FIG. 3 shows an embodiment of control circuits to be used in an arrangement according to the invention.

The control circuits used are all of the same construction. FIG. 3 shows a possible embodiment, the sub-band originating from a band-pass filter being applied to an input 45. The amplitude is determined in an amplitude detector consisting of a rectifier circuit 46 and a low-pass filter 47, whereafter the amplitude is standardized by means of a divider 48. In order to prevent the signal from being divided by zero in the absence of an input signal, a small d.c. voltage is added by means of an adder 49.

To compensate for the delay time of the low-pass filter 47, an analogue delay device 50 is used in the manner shown in the FIG. 3. This delay device is, for example, in the form of a bucket brigade memory.

It should be noted that when a peak rectifier is used for the amplitude detector, the delay device 50 may be omitted.

Figure 4:
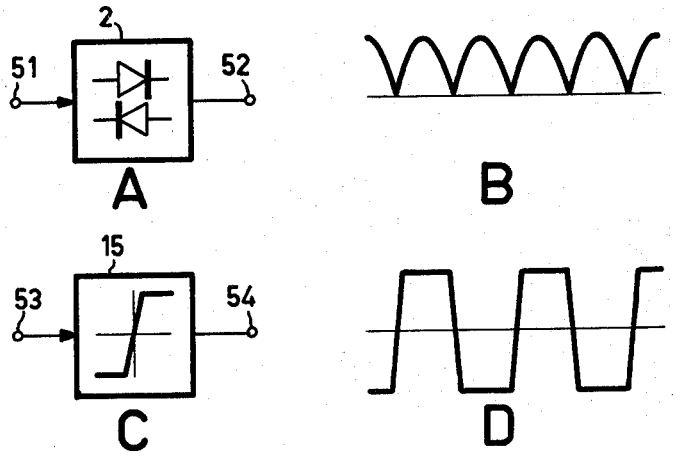
FIG. 4 is a schematic representation of the distortion circuits to be used and their associated output signals.

FIG. 4 shows schematically an example of the distortion circuits 2 and 15 to be used in the arrangements shown in the FIGS. 1 and 2. The circuit 2 shown in FIG. 4A is formed by a full-wave rectifier circuit. When a sinusoidal signal is applied to the input terminal 51, a signal will appear at the output 52, whose shape corresponds to the shape of the signal shown in FIG. 4B. The circuit 15 shown in FIG. 4C is formed by a limiter circuit which, in response to a sinusoidal signal at input terminal 53, will produce at an output terminal 54 a signal whose shape corresponds to the shape of the signal shown in FIG. 4D. It will be obvious that the frequency components generated by the distortion circuit 2 will be predominantly located in a lower band than the components generated by distortion circuit 15, so that the former is more suitable to produce an excitation signal for the sub-band of the lower frequency and the said second circuit can be used successfully to generate an excitation signal especially for the higher sub-bands. It should be noted that it is of course possible to use other distortion circuits. However, the shown combination of a full-wave rectifier circuit and a limiter circuit appeared to be very satisfactory in practice.

What is claimed is:

1. An arrangement for synthesizing speech from a band of low-frequency components of a speech signal and a plurality of narrow-band control signals which are characteristic of a plurality of sub-bands of high-frequency components of the speech signal, comprising means for generating a band of high-frequency components from the band of low-frequency components, means for dividing the band of high-frequency components into a number of sub-bands corresponding to the sub-bands of high-frequency components of the speech signal, means for correcting by means of the control signals the sub-bands derived from the generated band and means for combining the band of low-frequency components with the corrected sub-bands of the generated high-frequency components to form a speech output signal, characterized in that the means for generating a band of high-frequency components comprises at least two circuits, each generating a band of high-frequency components from the band of low-frequency components of the speech signal, a portion of the number of sub-bands being derived from each of the generated bands.

2. An arrangement as claimed in claim 1, characterized in that a first circuit of the at least two circuits is formed by a full-wave rectifier circuit for generating a relatively low-frequency band of high-frequency components and that a second circuit of the at least two circuits is formed by a limiter circuit for generating a relatively high-frequency band of high-frequency components.

* * * * *